United States Patent [19]

Russo

[11] 4,196,556

[45] Apr. 8, 1980

[54] FRAMING BRACKET

[76] Inventor: John C. Russo, 2100 General Collins St., New Orleans, La. 70114

[21] Appl. No.: 945,530

[22] Filed: Sep. 25, 1978

[51] Int. Cl.[2] ..... E04B 1/38

[52] U.S. Cl. ..... 52/714; 52/285; 403/230; 403/247

[58] Field of Search ..... 52/712, 713, 715, 210, 52/280, 648, 241, 281, 284, 695, 696, 92, 238, 285, 714, 289; 403/247, 170, 232.1, 231, 230, 262

[56] References Cited

U.S. PATENT DOCUMENTS

| | | | |
|---|---|---|---|
| 666,918 | 1/1961 | Butz | 403/232.1 |
| 1,540,140 | 6/1925 | Ohnstrand | 403/247 |
| 2,931,129 | 4/1960 | Boniface | 403/231 |
| 3,125,785 | 3/1964 | Conville | 52/285 |
| 3,188,696 | 6/1965 | Earhart | 52/712 |
| 3,333,875 | 8/1967 | Tracy | 52/648 |
| 3,363,392 | 1/1968 | Boughner | 52/715 |
| 3,945,741 | 3/1976 | Wendt | 403/231 |

FOREIGN PATENT DOCUMENTS

| | | | |
|---|---|---|---|
| 818416 | 7/1949 | Fed. Rep. of Germany | 403/232.1 |
| 93998 | 3/1959 | Norway | 403/232.1 |
| 105169 | 6/1924 | Switzerland | 403/231 |
| 1450871 | 9/1976 | United Kingdom | 52/714 |

*Primary Examiner*—John E. Murtagh

*Attorney, Agent, or Firm*—Charles C. Garvey, Jr.; Thomas S. Keaty

[57] ABSTRACT

A framing bracket for use in forming wall to wall connections such as "Tee" and "Corner Post" connections in for example house building using wooden building studs and sheet wall construction is comprised of a rectangular base member having a pair of side walls each, side wall connected along a portion of the base plate length. The side walls extend to the approximate central portion of the rectangular base member and provide respectively a pair of connected stop plates which are inwardly depending. The stop plates in combination with the side walls and a portion of the rectangular base plate member form a first partial enclosure for receiving the tip of a conventional building stud thereinto for connection by means of nails or the like. Typically, the upper or lower longitudinal stud of a framed stud wall will occupy this first partial enclosure during a "Tee" or "corner post" connection. (See FIGS. 5 and 6). A tie plate is attached to the end portion of the base plate opposite the first partial enclosure and forms a second partial enclosure between the tie plate and the central stop plate. The second enclosure forms a place typically for the attachment of a wall of sheet material such as gypsum board, wall board, sheetrock, or the like. Alternatively, the second partial enclosure can accommodate a longitudely running building stud and an abutting sheet of wall material, as when the framing bracket forms the top plate tie in "Tee" or "corner post" connections.

10 Claims, 6 Drawing Figures

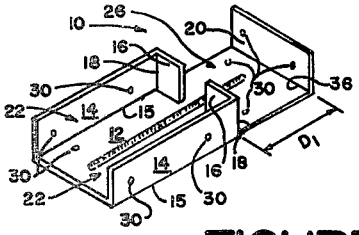
FIGURE 1
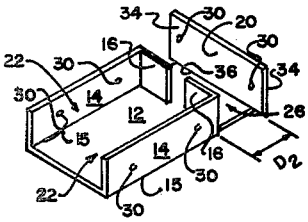
FIGURE 2
FIGURE 6
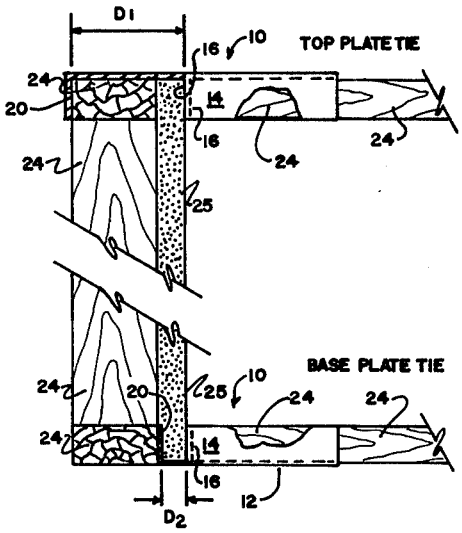
FIGURE 5
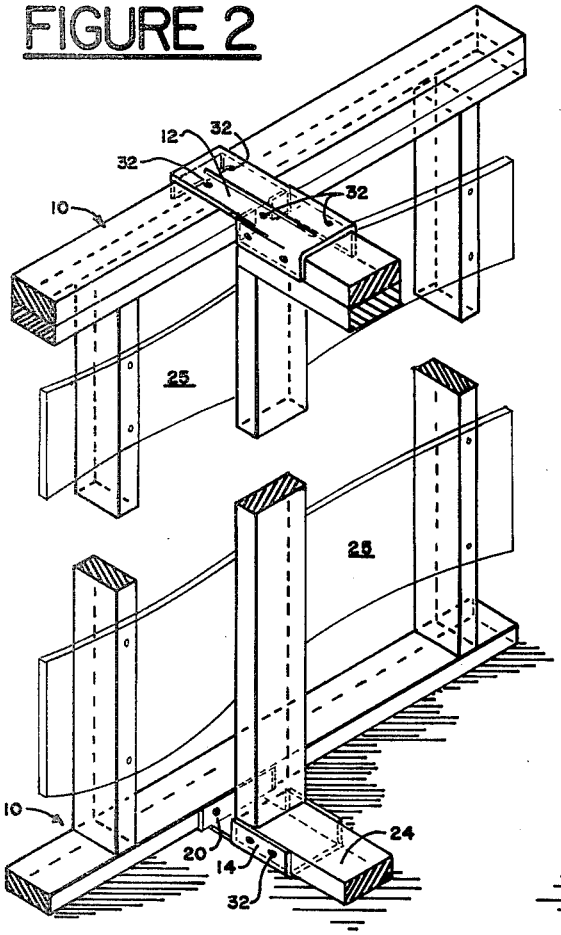
FIGURE 3
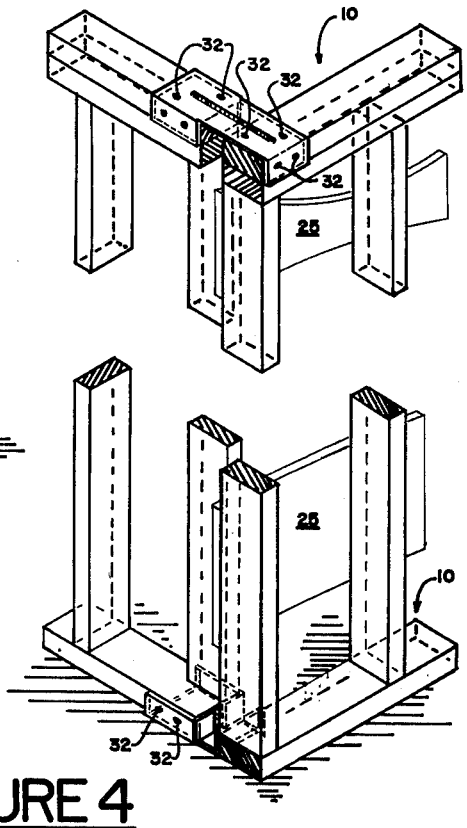
FIGURE 4

FRAMING BRACKET

BACKGROUND OF THE INVENTION

1. Field of the Invention

The present invention relates to a framing bracket for home and like building construction, for example, when building with conventional wooden studs and sheet wall material. More particularly, the present invention relates to a framing bracket for forming wall to wall connections such as "tee" connections and "corner post" connections in wood stud construction.

2. General Background and Prior Art

In home and generally light construction, builders normally form walls and crosswalls by assembling frames of a plurality of bulding "studs" which are generally conventional two inch by four inch by eight feet long wooden building members. Such building studs are known in the art and are generally wood, being of pine for example.

A wall is normally formed by arranging studs in parallel with a lower or base stud and an upper top member completing a rectangular frame. The vertical studs are usually spaced at sixteen inches (16") more or less on centers depending on local building codes.

These stud walls are normally covered with four foot by eight foot (4'×8') sheets of wall material such as gypsum, sheetrock, paneling, or the like. These constructed wall frames are connected end to end to form the outer walls and inner walls of homes, and like small buildings with an outer veneer of brick or wood siding or the like facing the outside and the weather. Such construction presently constitutes a tremendous volume of the construction industry, especially in home construction and in the construction of like small dwellings and buildings such as apartments, stores, shops and the like.

The covering of the formed wall frames with an inner sheet wall material such as gypsum board presents a problem wherever a corner must be formed or wherever a "tee" is formed with one wall branching off from another. It is to this general problem that the present invention is directed.

When a builder constructs a "tee" wall off his main wall, extra studs must be used above and beyond the normal sixteen inch centers in order that sheet material can be properly attached to both the main wall and the side wall which branches therefrom.

In the present construction industry, extra building studs or the like are added to provide surfaces for the attachment of this sheet material at such corner posts and tee connections.

This is a waste of materials, as the extra studs are not needed for strength, their primary purpose. They are added because there is a need for a surface to which the wall material can be attached by nailing for example.

This represents a significant waste of time and materials which is repeated over and over nation wide throughout the home building industry.

Therefore, it is an object of the present invention to provide a framing bracket which forms a "tee" or "corner post" connection of two wooden stud walls without the need of extra stud members at the connection.

It is a further object of the present invention to provide a framing bracket which is economical to manufacture and simple to use.

It is a further object of the present invention to provide a framing bracket which can be easily installed to form "tee" and "corner post" connections using conventional carpentry methods. It is yet another object of the present invention to provide a framing bracket for forming "tee" and "corner post" connections at the upper and lower surfaces respectively of such connections.

It is yet another object of the present invention to provide a "tee" and "corner post" connector which provides proper spacing so that wall material can be uninterruptedly affixed to both the base wall and side wall connected thereto.

3. General Discussion of the Present Invention

The present invention provides a framing bracket for forming wall to wall connections in buildings using wooden stud and sheet wall construction. The framing bracket of the present invention is comprised of a substantially rectangular base plate member having a pair of substantially coplanar side walls connected to the edges of the base plate and extending along a portion of its length. A pair of stop tabs are inwardly depending on each of these side walls respectively at the central portion of the base plate member. The pair of side walls, the pair of stop tabs, and a portion of the base plate thus define a first partial enclosure for receiving the tip of a building stud for connection therewith. The building stud registers with and fits into the partial enclosure. This first partial enclosure would normally hold the upper or lower longitudinal stud member of a side wall such as is provided in "tee" connections. A tie plate is connected to the end portion of the base plate member opposite the first partial enclosure, the tie plate and the pair of stop tabs being substantially coplanar and defining a second partial enclosure therebetween. The second partial enclosure receives the edge portion of a sheet of wall material such as gypsum board therein. Thus, the pair of stop tabs provides a separation between the building stud tip and the sheet of wall material with the sheet of wall material filling in the space between the pair of stop tabs and the tie plate.

In an alternative embodiment, the space between the stop tabs and the tie plate is enlarged to provide a space for a sheet of wall material and its attached building stud. The latter embodiment would be useful in the top plate ties (See FIG. 4), while the first embodiment would be most useful with the base plate ties (see FIG. 3).

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 1 is a perspective view of the preferred embodiment of the apparatus of the present invention;

FIG. 2 is a perspective view of the second embodiment of the apparatus of the present invention;

FIG. 3 is a partial view of a typical top plate and base plate tie at a "tee" connection;

FIG. 4 is a partial perspective view illustrating a top plate and base plate tie at a "corner post" connection.

FIG. 5 is a sectional view illustrating a base plate tie connection using the preferred embodiment of the apparatus of the present invention;

FIG. 6 is a sectional view illustrating a top plate tie using the preferred embodiment of the apparatus of the present invention.

DETAILED DESCRIPTION OF THE PREFERRED EMBODIMENT

FIGS. 1 and 2 best illustrates the preferred embodiment of the apparatus of the present invention designated generally by the numeral 10. In FIGS. 1 and 2 there can be seen a base plate member 12 which is substantially rectangular having rectangular side walls 14 which are integrally joined at edge 15 to base plate member 12. Side walls 14 are attached at edges 15 integrally with base plate 12 along a portion of the length of base plate 12 terminating generally at the central portion thereof. Note that a pair of stop tabs 16 are inwardly depending from side walls 14 respectively at the central portion of base plate 12.

Tie plate 20 which is substantially rectangular is provided at the end portion of base plate 12 opposite the end to which side walls 14 and tabs 16 are attached.

Side walls 14, stop tabs 16, and a portion of base plate 12 form a first partial enclosure or chase 22 which is receptive of the end tip portion of a building stud 24 thereinto, (typically either the upper or lower longitudinal stud member of a stud wall frame as shown in FIGS. 3–6).

A second partial enclosure or chase 26 is provided between stop tab 16 and tie plate 20. In FIGS. 1 and 2, this second partial enclosure 26 is of a width $D_1$ which can vary as is illustrated by FIGS. 1 through 6. In the embodiment shown in FIG. 2 width $D_2$ would preferably be somewhat smaller and receptive of the thickness of a section of wall material 25 thereinto. (See FIGS. 3 and 5).

In FIGS. 1 and 6, there is seen a distance $D_1$ which is preferably sized to accomodate both a conventional building stud 24 and a section of wall material 25 and as is best illustrated in FIG. 6 in top plate ties.

Note that bracket 10 is provided with a plurality of openings 30. Openings 30 are shown in the preferred embodiment on walls 14, base plate member 12, and tie plate 30. Openings 30 provide a place for the insertion and attachment of nails or other suitable fasteners through bracket 10 into the wooden stud 24 or wall of sheet material 25, a connection perfected.

In FIG. 2, note that tie plate 20 is integrally attached to base plate 12 at edge 36. A pair of laterally extending ears 34 is provided on tie plate 20 in FIG. 2. These ears 34 would preferably be "bendable" to accomodate both "tee" and "corner post" connections. (See FIGS. 3 and 4). Note from an inspection that FIGS. 3 and 4 that nails 32 or like fasteners can be used to make a suitable connection through openings 30 and into stud members 24 for a suitable structural connection.

Framing bracket 10 would be manufactured of a suitable structural material such as a metal, plastic, fiberglass, or the like with an eighteen guage (18 Ga.) sheet metal being a suitable material. A typical preferred embodiment of the present invention would be of a length of approximately ten inches, with second partial enclosure 26 having a depth $D_1$ of four and three eights inches (for the embodiment holding both a stud 24 and wall material 25), and a three quarter inch (¾") depth $D_2$ for the embodiment (FIG. 2) holding wall material 25 only in second partial enclosure or chase 26. First partial enclosure or chase 22 would preferably have a width corresponding to the width of a conventional two by four building stud which would be approximately three and eleven sixteenths inches (3 11/16"). In a like manner, walls 14 could be of a height and of a width equal to or somewhat larger than the width of base plate 12, so as to provide ears 34 if desired as above described. Thus, tie plate 20 could have a six and three sixteenth inch (6 and 3/16") preferred width. Each stop tab 16 could be one and one quarter inches (1¼") high by three quarter inches (¾") in width.

The illustration of framing bracket 10 in FIGS. 3 and 4 show a typical "tee" connection (FIG. 3) and a typical corner post connection (FIG. 4). Each view is a partial perspective, showing a top plate tie at the upper portion of the figure using bracket 10 as shown in FIG. 1, and a base plate tie at the lower portion of the figure using bracket 10 as shown in FIG. 2.

Framing bracket 10 could be embossed for adding strength if desired.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A framing bracket for forming wall to wall connections in building stud and sheet wall construction, comprising:
   a. a rectangular base plate member;
   b. a pair of side walls connected to the edges of said base plate and extending along a portion of its length;
   c. a stop plate connected to at least one of said side walls at the central portion of said base plate member, said stop plate, a portion of said base plate and said side walls defining a first three sided partial enclosure for receiving the tip of a building stud thereinto for connection therewith;
   d. fastner means for forming a connection with said framing bracket and the building stud tip; and
   e. a tie plate attached to the end portion of said base plate opposite said first partial enclosure, said tie plate, said stop plate and a portion of said base plate member defining a second partial enclosure adapted to connectably receive a sheet of wall material therebetween, said tie plate being adapted for attachment to a base wall stud member.

2. The framing bracket of claim 1 wherein said tie plate, said stop plate, and a portion of said base plate define a second partial enclosure adapted to receive a portion of a sheet of wall material and a portion of a building stud therebetween.

3. The framing bracket of claim 1 wherein said fastener means is at least one opening in one of said side walls, at least one opening in said base plate, and at least one opening in said tie plate, said fastener means further comprising a plurality of nails insertable through said openings into the contained building stud and wall material.

4. The framing bracket of claim 1 wherein said side walls and said tie plate rectangular, and said tie plate are extends laterally a distance in each lateral direction greater than the width of said base plate member, providing a pair of mounting ears.

5. The framing bracket of claim 1 wherein said tie plate is manufactured of a bendable material allowing said mounting ears to be bent pivotally.

6. A building stud and wall framing bracket comprising:

a. a rectangular base plate member;

b. a pair of substantially coplanar sidewalls connected to said base plate member along a portion of the sides of said base plate member, said side walls beginning at one end portion of said base plate member and generally terminating at the central portion of said base plate member;

c. a pair of stop tabs inwardly depending from each of said side walls respectively at the central portion of said base plate member, said pair of sidewalls, said pair of stop tabs and a portion of said base plate defining a first partial enclosure for receiving the tip of a building stud for connection therewith the building stud tip registering with and fitting into said first partial enclosure;

d. a tie plate connected to the end portion of said base plate member opposite said first partial enclosure, said tie plate and said pair of stop tabs being substantially coplanar and defining a second partial enclosure therebetween said second partial enclosure adapted for receiving a sheet of wall material therein, said pair of stop tabs providing a separation between the building stud tip and the sheet of wall material, said tie plate having at least one opening for the insertion of a fastener therethrough, for connecting said tie plate to building stud wall behind said tie plate and opposite said framing bracket;

e. at least one opening in said base plate, each of said sidewalls and said tie plate, each of said openings providing a passage for inserting a fastener therethrough to the building stud tip placed within said first partial enclosure.

7. The framing bracket of claim 6 wherein said tie plate extends laterally a distance in each direction beyond the width of said base plate member.

8. The framing bracket of claim 6 wherein said pair of sidewalls are substantially rectangular and each of said stop tabs is rectangular, being an extension of each sidewall respectively.

9. The framing bracket of claim 6 wherein said tie plate is spaced a distance from said pair of stop tabs to provide a second partial enclosure receptive of a section of a building stud and a connected sheet of wall material.

10. The framing bracket of claim 6, wherein said second partial enclosure is adapted to receive a portion of a building stud and an attached sheet of wall material at least in part.

* * * * *